United States Patent [19]

Spiller

[11] 4,112,668

[45] Sep. 12, 1978

[54] METHOD FOR TREATING POLYESTER FILAMENTS

[75] Inventor: Herbert A. Spiller, Pine Bluff, Ark.

[73] Assignee: Monsanto Company, St. Louis, Mo., Decatur, Ala.

[21] Appl. No.: 807,474

[22] Filed: Jun. 17, 1977

Related U.S. Application Data

[63] Continuation of Ser. No. 729,566, Oct. 4, 1976, abandoned.

[51] Int. Cl.[2] ..... D02J 1/22; D01G 1/06

[52] U.S. Cl. ..... 57/157 S; 28/281; 264/290 T

[58] Field of Search ..... 57/2, 157 R, 157 S, 57/157 TS, 157 MS; 28/281; 264/210, 290 T

[56] References Cited

U.S. PATENT DOCUMENTS

| | | | |
|---|---|---|---|
| 3,389,207 | 6/1968 | Macleod | 264/290 T |
| 3,423,501 | 1/1969 | Dennis et al. | 28/281 X |
| 3,567,817 | 3/1971 | Spiller | 264/290 T |
| 3,770,866 | 11/1973 | Sakata et al. | 264/290 T |
| 3,803,826 | 4/1974 | Ishizawa et al. | 57/157 TS X |
| 3,816,486 | 6/1974 | Vail | 264/290 T X |
| 3,977,175 | 8/1976 | Yoshikawa et al. | 57/157 TS |

FOREIGN PATENT DOCUMENTS

| | | | |
|---|---|---|---|
| 992,670 | 5/1965 | United Kingdom | 264/290 T |

*Primary Examiner*—Donald Watkins
*Attorney, Agent, or Firm*—Robert L. Broad, Jr.

[57] ABSTRACT

The method for production of polyester staple yarn having sufficiently low elongation and shrinkage and high tenacity and modulus for use in thread, sewing thread, cord, twine and in cordage products, wherein a tow of conventionally spun polyester filaments is drawn in an aqueous draw zone and then dried at 130° to 140° C, stretched 1.1 to 1.2X and then heat set at 170° to 200° C. The tow is then crimped, cut to staple and spun into yarn. The dwell time between the drying step and the step of stretching 1.1 to 1.2 times is sufficiently low that this stretch can be accomplished before the fibers in the tow can crystallize to the point that this stretch cannot be achieved. Dwell time in the heat set zone must be at least 10 seconds.

4 Claims, 2 Drawing Figures

METHOD FOR TREATING POLYESTER FILAMENTS

This is a continuation of application Ser. No. 729,566 filed Oct. 4, 1976, now abandoned.

BACKGROUND OF THE INVENTION a. Field of the Invention

This invention relates to methods for treating polyester filaments to cause the filaments to have low elongation and shrinkage and high tenacity and modulus.

b. Description of the Prior Art

Yarns spun from conventional polyester staple fibers are generally unsuited for use as sewing thread for the reason that these yarns have elongation and shrinkage values which are too high and tenacity and modulus values which are too low. Stitch definition in clothing fabricated with such a thread tends to become very poor when the garment is subjected to conventional usage. If the elongation of the sewing thread is too great, the stitches will stretch when a load is applied to the fabric. If the shrinkage of the sewing thread is too high, the stitches may shrink when the garment is washed. Generally, a sewing thread which will maintain a superior stitch definition throughout various conditions of usage and washing must have a low elongation and a high tenacity.

DETAILED DESCRIPTION OF THE INVENTION

Figure 1:
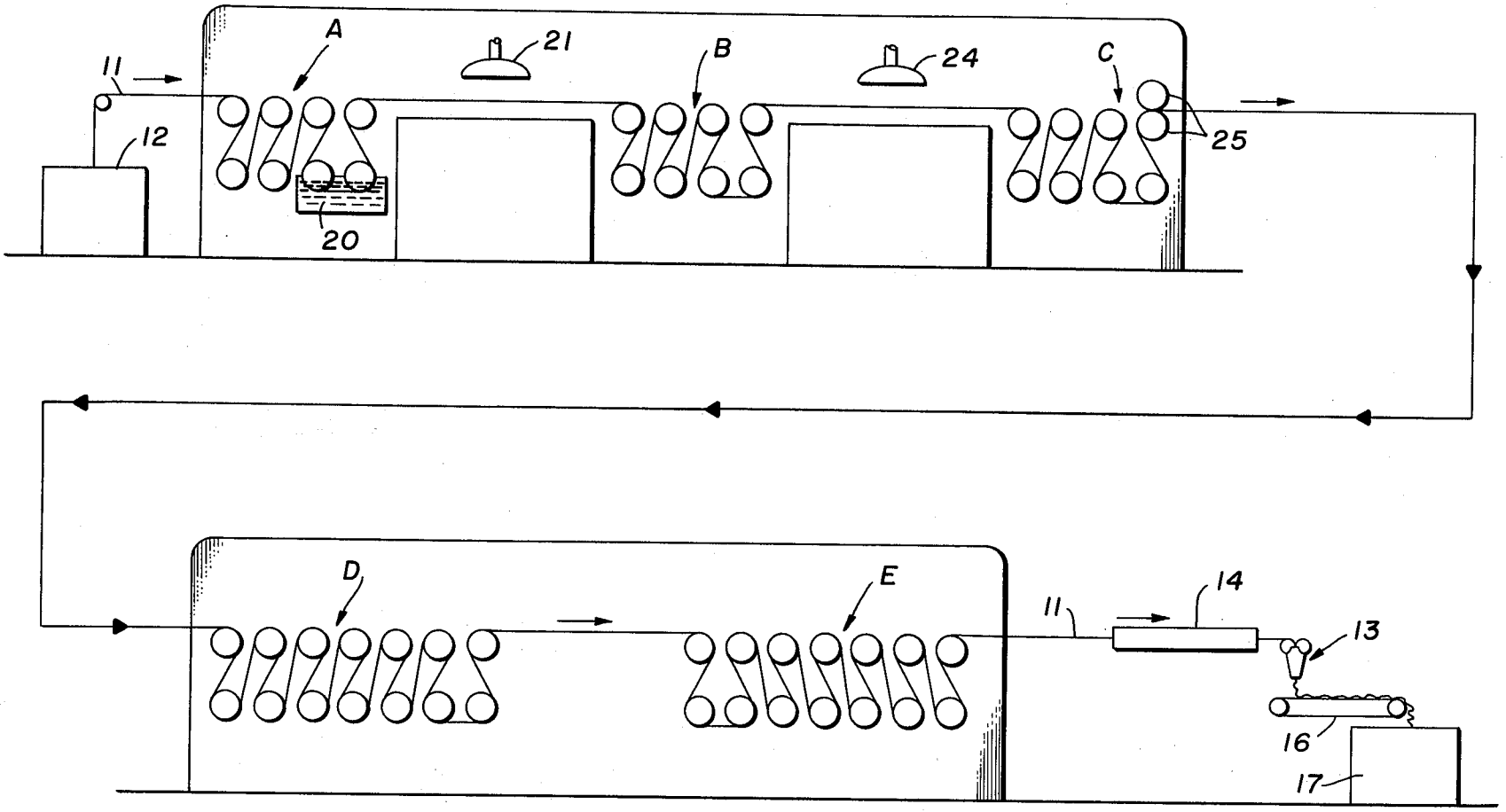
FIG. 1 of the drawings schematically shows apparatus for carrying out one embodiment of the invention.

Referring now in detail to FIG. 1 of the drawing, there is schematially shown apparatus for carrying out one embodiment of the present invention. Tow 11 from a container 12 passes sequentially over roll groups A, B, C, D and E and through a steamer 14 to a crimper 13 and is then fed by a moving belt 16 into a container 17. In moving through roll group A the tow 11 passes through a bath 20 where it is preheated to about 70° to 80° C and then passes through an aqueous shower at about 80° to 100° C, this shower being applied by a spray head 21. Roll group B is driven at such a peripheral speed that the tow is stretched 2.5 to 6X between roll groups A and B.

The tow then passes through a 90° to 100° C aqueous shower from a spray head 24 positioned between Roll groups B and C. Roll group C is driven at such a peripheral speed that the tow is drawn between about 1.1 and 2X between roll groups B and C. Roll group C includes a pair of squeeze rolls 25 for removing excess water from the tow.

The tow then enters roll group D, these rolls being heated sufficiently to heat the tow to a temperature of about 130° to 140° C as the tow passes through this roll group. The rolls in roll group E are driven at such a peripheral speed that the tow is stretched about 1.1 to 1.2X between roll groups D and E. The rolls in group E are heated to a sufficient temperature that the tow is heated to a temperature of 170° to 200° C to heat set the tow as it passes through roll group E.

It is critical that the time interval between the tows reaching a temperature of 130° to 140° C and the stretching of 1.1 to 1.2X between roll groups D and E be sufficiently short that the tow can be stretched this amount before the filaments in the tow become crystallized. If this time interval is too long, the filaments will crystallize to the point that this amount of stretch cannot be taken without filament breakage. It is also critical that the tow be heated to 170° to 200° C in roll Group E for a period of at least 10 seconds to heat set the tow. Preferably, the tow is heat set at 170° to 185° C.

Figure 2:
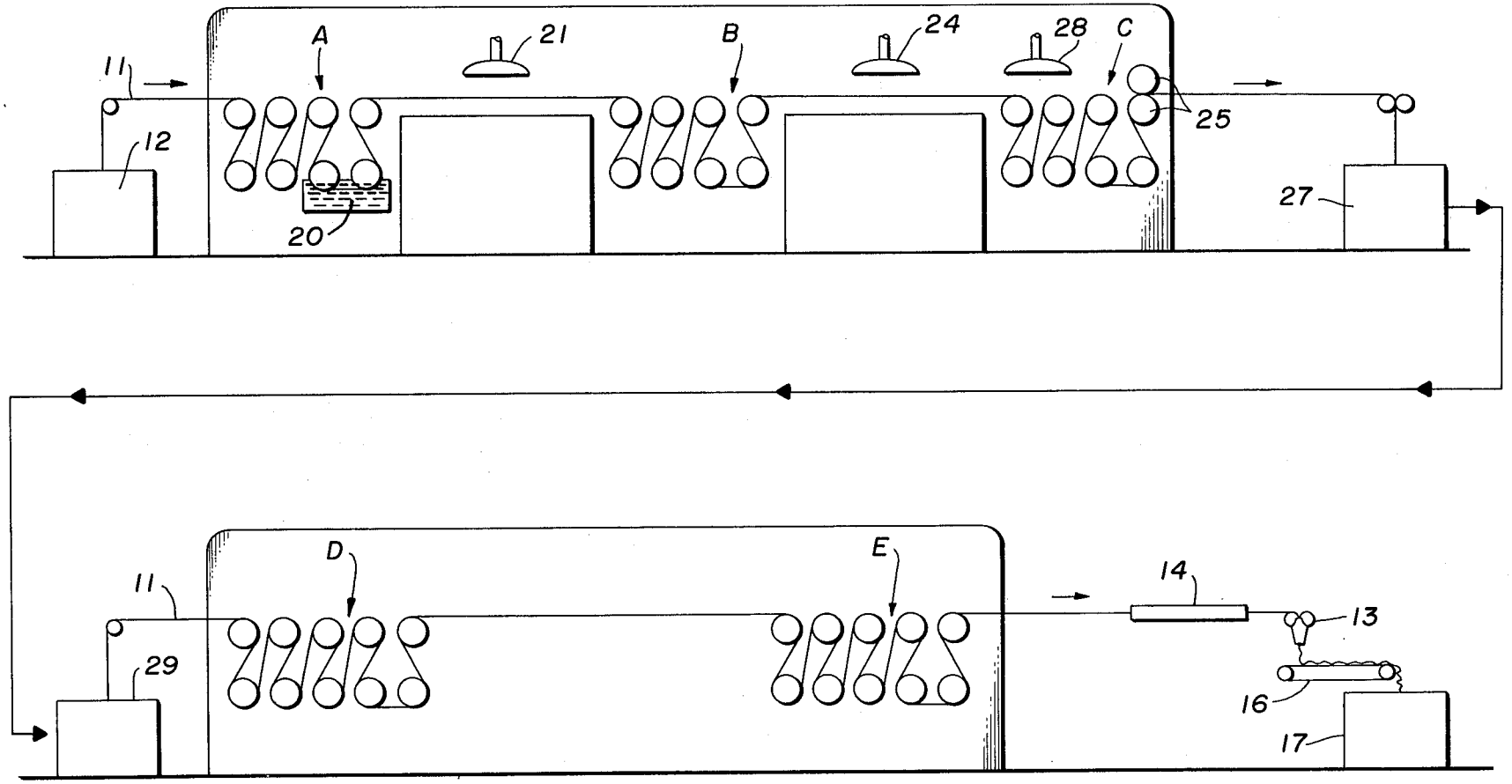
FIG. 2 schematically shows apparatus useful in carrying out a second embodiment of the invention.

The various steps of heating and stretching described above are used when the process of the invention is carried out on the apparatus shown in FIG. 2. When using this apparatus the tow 11 entering roll group C is quenched to a temperature below about 60° C by a cold aqueous shower from a spray head 26. After passing between the squeeze rolls 25 the tow is collected in a container 29 in a wet, uncrimped condition. The tow 11 is taken from the container 29 and fed through the roll groups D and E as described above, through the steamer 14 and the crimper 13 and is collected in the container 17. Again, it is critical that the time period between the time when the filaments are heated to 130° to 140° C and the stretching which occurs between roll groups D and E sufficiently short that the tow can be stretched 1.1 to 1.2X without filament breakage at this point. Normally, this time will be only a few seconds. Also, it is critical that the dwell time of the tow in roll group E is such that the tow is maintained at a temperature of 170° to 200° C for at least 10 seconds.

The heating and stetching steps and critical factors are the same in both processes. In the first embodiment the process is continuous, while in the second embodiment the tow is quenched to below about 60° C and may be stored in a wet, uncrimped condition prior to the final stretching step.

In each of the embodiments the tow is, after heat setting, cut into staple and spun into a yarn, preferably on a cotton or wool system.

The process of the present invention produces polyester filaments which have low elongation and shrinkage and high tenacity and modulus such that it is ideally suited for use as sewing thread, cord, twine and in cordage products.

EXAMPLE 1

A tow of 24 dpf polyester filaments having a total denier of 635,000 was passed through the apparatus shown in FIG. 2 of the drawing. The tow was heated to about 75° C in the bath 20 and was then exposed to an aqueous spray at 87° C from the spray head 21 prior to entering roll group B. The speed of roll group B was such that the tow was stretched about 4.32X between roll groups A and B. The temperature of about 75° C was maintained as the tow passed through roll group B, with the tow being exposed to a 92° C aqueous spray from the spray head 24 between roll groups B and C. The speed of roll group C was such that the tow was stretched about 1.21X between roll groups B and C. As the tow entered roll group C a spray head 28 applied a cold aqueous spray to the tow to quench the filaments in the tow to a temperature below about 60° C. The tow moisture content was reduced to about 15 weight percent by squeeze rolls 25 and the tow was collected in the container 29. The container 29 was moved into position adjacent to roll group D and the tow was passed through roll group D where it was heated to a temperature of about 135° C. The tow was then passed through roll group E, the rolls in this group having a peripheral speed such that the tow was stretched about 1.15X between roll group D and roll group E. The temperature of the rolls in roll group D and the speed of the tow was such that the tow was stretched between roll group D and roll group E before the filaments in the tow had crystallized to the point where the tow could not be stretched without fiber breakage.

In roll group E, the tow was heated to a temperature of about 175° C to heat set the tow, with the tow remaining at this temperature for about 10 seconds. The heat set tow was then steamed and passed through the stuffer box crimper 13 onto the conveyor belt 16 which deposited the tow in the carton 17. At this point, the filaments in the tow had a denier of about 4.75.

The tow was cut up into staple having a staple length of about 4.5 inches and formed, by using the cotton spinning system, into a yarn having a cotton count of 6.6 and a Z twist of 8 per inch. The yarn had a breaking strength of 3.45 Kg (4.3 grams/denier), an elongation at break of 13.4% and a shrinkage of 2.5 percent in boiling water. Individual filaments making up the yarn had a tenacity of 6.2 grams/denier, a boiling water shrinkage of less than 2 percent and an elongation of 38.6 percent.

Conventional polyester staple filaments have a tenacity of 3.5 to 5.0 grams/denier and an elongation of 50 – 70 percent.

What is claimed is:

1. The method for treating polyester filaments to cause said filaments to have sufficiently low elongation and shrinkage and high tenacity and modulus for use in sewing thread, cord, twine and in cordage products, comprising a. heating a tow of polyester filaments to about 70° – 80° C,
b. wetting the tow amd stretching the wet tow about 2.5 to 6X,
c. heating the tow to about 90° – 100° C,
d. stretching the tow 1.1 to 2X,
e. drying the tow at a temperature of about 130° – 140° C,
f. stretching the dried tow 1.1 to 1.2X, said stretching taking place within a sufficiently short time interval following said drying that said stretching can be accomplished without filament breakage, and
g. heat setting the tow at a temperature of 170° to 200° C for a period of at least 10 seconds.

2. The method of claim 1 wherein the tow is heat set for at least 10 seconds at 170° – 185° C.

3. The method of treating polyester filaments to cause said filaments to have sufficiently low elongation and shrinkage and high tenacity and modulus for use in sewing thread, cord, twine and cordage products, comprising a. heating a tow of polyester filaments to about 70° – 80° C,
b. wetting the tow and stretching the wet tow 2.5 to 6X,
c. heating the tow to about 90° – 100° C,
d. stretching the tow about 1.1 to 2X,
e. quenching the tow to a temperature below about 60° C,
f. reducing the moisture content of the tow to below about 15 weight percent,
g. crimping the tow,
h. drying the tow at a temperature of about 130° – 140° C,
i. stretching the dried tow 1.1 to 1.2X, said stretching taking place within a sufficiently short time interval following said drying that said stretching can be accomplished without filament breakage, and
j. heat setting the tow at a temperature of 170° – 200° C for a period of at least 10 seconds.

4. The method of claim 3 wherein the tow is heat set for at least 10 seconds at 170° – 185° C.

* * * * *